US012351375B2

(12) United States Patent
Kuperus

(10) Patent No.: US 12,351,375 B2
(45) Date of Patent: Jul. 8, 2025

(54) LIGATION ASSEMBLY AND METHOD FOR USING THE SAME

(71) Applicant: Brian Kuperus, Hopkins, MI (US)

(72) Inventor: Brian Kuperus, Hopkins, MI (US)

( * ) Notice: Subject to any disclaimer, the term of this patent is extended or adjusted under 35 U.S.C. 154(b) by 0 days.

(21) Appl. No.: 18/115,236

(22) Filed: Feb. 28, 2023

(65) Prior Publication Data

US 2024/0286810 A1 Aug. 29, 2024

(51) Int. Cl.
*B65D 63/10* (2006.01)

(52) U.S. Cl.
CPC ..... *B65D 63/1027* (2013.01)

(58) Field of Classification Search
CPC ..... B65D 63/1027
See application file for complete search history.

(56) References Cited

U.S. PATENT DOCUMENTS

| | | | |
|---|---|---|---|
| 2,870,503 | A | 1/1959 | McAneny |
| 2,979,794 | A | 4/1961 | DeBartolo |
| 3,149,808 | A | 9/1964 | Weckesser |
| 3,155,355 | A | 11/1964 | Cappola |
| 3,214,808 | A | 11/1965 | Litmin |
| 3,368,247 | A | 2/1968 | Orban |
| 3,484,905 | A | 12/1969 | Eberhardt |
| 3,581,347 | A | 6/1971 | Verspieren |
| 3,660,869 | A | 5/1972 | Caveney et al. |
| 3,816,878 | A | 6/1974 | Fulton et al. |
| 3,874,034 | A | 4/1975 | Clayton |
| 3,892,011 | A | 7/1975 | Kohke |
| 3,967,345 | A | 7/1976 | Sumimoto |
| 3,996,646 | A | 12/1976 | Caveney |
| 4,001,898 | A | 1/1977 | Caveney |
| 4,222,155 | A | 9/1980 | Oetiker |
| 4,227,668 | A | 10/1980 | Ernst |
| 4,287,644 | A | 9/1981 | Durand |
| 4,333,210 | A | 6/1982 | Burnett |
| 4,456,123 | A | 6/1984 | Russell |
| 4,466,159 | A | 8/1984 | Burrage |
| 4,631,782 | A | 12/1986 | Gecs |
| 4,676,535 | A | 6/1987 | Mautner |
| 4,691,704 | A | 9/1987 | Wadsworth |
| 4,726,115 | A | 2/1988 | Hartman |
| 4,783,886 | A | 11/1988 | Koppe |
| 4,862,561 | A | 9/1989 | Lichtenberg |

(Continued)

FOREIGN PATENT DOCUMENTS

| | | |
|---|---|---|
| JP | 2004-298501 | 10/2004 |
| WO | WO 2011/015968 | 2/2011 |

OTHER PUBLICATIONS

Office Action for U.S. Appl. No. 15/398,257 dated Oct. 6, 2017.

(Continued)

*Primary Examiner* — David M Upchurch
(74) *Attorney, Agent, or Firm* — King & Partners, PLC

(57) ABSTRACT

A ligation assembly having a locking head, an elongated strap body, wherein the elongated strap body includes a bottom surface that is free from ratchet teeth, and wherein the elongated strap body is spaced apart from the locking head, and a coupling member, wherein the coupling member is connected to and disposed between the locking head and the elongated strap body, and wherein the coupling member is fabricated from an elastomeric material.

1 Claim, 8 Drawing Sheets

(56) References Cited

U.S. PATENT DOCUMENTS

| | | | | |
|---|---|---|---|---|
| 4,896,402 | A | 1/1990 | Jansen et al. | |
| 4,958,414 | A | 9/1990 | Benoit | |
| 5,028,225 | A | 7/1991 | Staheli | |
| 5,121,524 | A | 6/1992 | Mortensen | |
| 5,146,654 | A | 9/1992 | Caveney et al. | |
| 5,236,434 | A | 8/1993 | Callicrate | |
| 5,377,387 | A | 1/1995 | Freed | |
| 5,467,507 | A | 11/1995 | Marsh et al. | |
| 5,690,522 | A * | 11/1997 | Moreau | F16L 3/137 441/1 |
| 5,836,053 | A | 11/1998 | Davignon et al. | |
| 5,884,367 | A | 3/1999 | Teagno et al. | |
| 6,076,234 | A | 6/2000 | Khokhar et al. | |
| 6,102,347 | A | 8/2000 | Benoit | |
| 6,138,327 | A * | 10/2000 | Powell | B29C 45/14467 24/298 |
| 6,185,791 | B1 | 2/2001 | Khokhar | |
| 6,185,792 | B1 | 2/2001 | Nelson et al. | |
| 6,745,439 | B2 | 8/2004 | Brownlee et al. | |
| 6,928,701 | B2 | 8/2005 | Hutter, III | |
| 7,017,237 | B2 | 3/2006 | Magno, Jr. et al. | |
| 7,337,502 | B2 | 3/2008 | Mermelshtein | |
| 7,360,281 | B1 | 4/2008 | MacCartey | |
| 7,464,442 | B2 | 12/2008 | Laporte | |
| 7,730,592 | B2 | 6/2010 | Krisel | |
| 7,866,005 | B2 | 1/2011 | Vermeet et al. | |
| 8,037,579 | B2 | 10/2011 | Tomasetti | |
| 8,056,192 | B1 | 11/2011 | Posner | |
| 8,276,244 | B2 | 10/2012 | Vermeer et al. | |
| 8,387,215 | B2 | 3/2013 | Koncelik, Jr. | |
| 8,474,104 | B2 | 7/2013 | Watson | |
| 8,510,918 | B2 | 8/2013 | Shilale et al. | |
| 8,590,112 | B2 | 11/2013 | Nelson et al. | |
| 8,726,468 | B2 | 5/2014 | Dyer | |
| 9,038,246 | B2 | 5/2015 | Liang | |
| 9,188,249 | B2 | 11/2015 | Owen | |
| 9,611,083 | B2 | 4/2017 | Schuttler | |
| 10,045,783 | B2 | 8/2018 | Callicrate et al. | |
| 10,435,214 | B2 | 10/2019 | Kuperus | |
| 10,772,634 | B2 | 9/2020 | Callicrate et al. | |
| 10,882,674 | B2 | 1/2021 | Kuperus | |
| 2010/0146742 | A1 * | 6/2010 | Every | B65D 63/1063 24/16 PB |
| 2010/0223763 | A1 * | 9/2010 | Shilale | B65D 63/1072 24/16 PB |
| 2014/0259543 | A1 | 9/2014 | Scott | |
| 2018/0187703 | A1 * | 7/2018 | Kuperus | A61B 17/1322 |
| 2018/0201419 | A1 * | 7/2018 | Kuperus | B65D 63/109 |

OTHER PUBLICATIONS

Office Action for U.S. Appl. No. 15/398,257 dated May 3, 2018.
Office Action for U.S. Appl. No. 15/398,257 dated Jun. 12, 2019.
Office Action for U.S. Appl. No. 15/860,924 dated May 29, 2018.
Office Action for U.S. Appl. No. 15/860,924 dated Dec. 31, 2018.
Office Action for U.S. Appl. No. 16/595,907 dated Apr. 15, 2020.
PCT Written Opinion of the International Searching Authority for International Application No. PCT/US18/12166 mailed May 1, 2018.

* cited by examiner

LIGATION ASSEMBLY AND METHOD FOR USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to ligation assemblies (e.g., tie-wraps, cable ties, hose ties, zip ties, zap straps, panduit straps, closed-bands, etcetera) and, more particularly, to novel toothless tie-wrap assemblies that comprise an elastomeric subassembly or coupling positioned generally between the tie-wrap head and the elongated strap to ensure that the tie-wrap assembly engages the banded object with both constant and sufficient tension. The present invention further relates to methods for utilizing the novel toothless tie-wrap assemblies for ligation and/or elastration of animals, thereby eliminating the need for conventional banding tools, which are both expensive and cumbersome. The ligation assemblies of the present invention are also suitable for use as tourniquets.

2. Background Art

Ligation assemblies, tie-wraps and cable ties have been known in the art for years and are the subject of a plurality of patents and/or publications, including, for example: U.S. Pat. No. 8,590,112 entitled "Cable Tie," U.S. Pat. No. 8,276,244 entitled "Elastomeric Releasable Cable Tie," U.S. Pat. No. 7,464,442 entitled "Bundling Tie," U.S. Pat. No. 7,337,502 entitled "Fastening System," U.S. Pat. No. 6,745,439 entitled "Cable Tie with Wide Neck," U.S. Pat. No. 6,185,792 entitled "Bi-Directional Self-Locking Cable Tie," U.S. Pat. No. 6,185,791 entitled "Releasable Cable Tie," U.S. Pat. No. 5,836,053 entitled "Cable Tie," U.S. Pat. No. 4,958,414 entitled "Reusable Tie-All or Bundle Fastener," U.S. Pat. No. 4,896,402 entitled "Cable Tie," U.S. Pat. No. 4,287,644 entitled "Coil Loop Type Cable Tie," and U.S. Pat. No. 3,660,869 entitled "One-Piece Cable Tie," all of which are hereby incorporated herein by reference in their entirety—including all references cited therein.

U.S. Pat. No. 8,590,112 appears to disclose a cable tie having a head for receiving a tail for binding various objects wherein a head of an integral buckle is tilted so that the tail portion is more easily received. By employing a tilted head, of preferably 30 degrees, a 15-20% increase in performance over similar cables ties of the prior art has been achieved. In addition, a cable tie is provided that includes a bulged or coined portion. A leading edge of the band that is associated with the buckle also includes a bulged or coined portion. The bulged portions are preferably created by a coining process and facilitate binding mechanically the band to the buckle. In addition, a cable tie is provided wherein a head of the integral buckle is interconnected to the band via angled side walls. The angled side walls increase an opening in the buckle that receives the band such that during tensioning less energy is needed to tension the cable tie around, for example, a bundle of cables.

U.S. Pat. No. 8,276,244 appears to disclose an elastomeric releasable cable tie having a head and a strap extending from the head. The head includes an end wall, an inner wall and sidewalls. The end wall, inner wall and sidewalls define a channel that extends from an entrance end to an exit end of the head. The head also includes a hingeless wedge extending from the end wall into the channel for engaging the strap.

U.S. Pat. No. 7,464,442 appears to disclose a tie for the bundling of one or more articles. A deformable tie has an elongate strap including an elongate tail at one end and a locking head at the other end. The locking head includes a pair of holding tabs defining a passageway therethrough and slot spaced from the holding tabs having a raised wall. The tie is placed about the articles to be bundled. The tail is inserted through the passageway of the holding tabs in a first direction. The tail is then passed through the slot in the first direction. The tail is bent around the raised slot wall so as to extend in a second direction opposite the first direction. The tail is then passed through the passageway of the holding tab in the second direction and the tail is bent around the holding tab so as to extend back in the first direction.

U.S. Pat. No. 7,337,502 appears to disclose a fastening system that comprises an elongate strap body having a pair of opposed side portions and a top surface between the side portions. The fastening system also includes a plurality of spaced male protrusions extending therefrom the top surface of the elongate strap body a protrusion height. Each protrusion includes two faces and a protrusion axis, which is substantially perpendicular to the longitudinal axis. The fastening system comprises the ability to form a slit in the top surface of the strap body at almost any location. The slit may generally extend between the pair of side portions, substantially parallel to the protrusion axis and between adjacent male protrusions. The slit may also include end segments extending substantially parallel to the longitudinal axis of the elongate strap body, forming a "tongue."

U.S. Pat. No. 6,745,439 appears to disclose a cable tie that includes an integral cable tie head and strap. The strap includes a first end forming a neck section, a free end opposite the first end, and an intermediate section between the first end and the free end, the intermediate section having a predetermined width $B_1$ and thickness $T_1$ defining a predetermined cross-sectional area. The cable tie head is secured to the neck area of the strap at the first end of the strap, the cable tie head having a width E that is wider than strap width B and including a strap accepting channel containing a locking device. The strap accepting channel is sized to receive the free end of the strap. The neck section has a width that transitions from a width of B to a width E' that is substantially the same as width E and a thickness $T_2$ that is thinner than $T_1$, the neck section having a cross-sectional area that is at least substantially equal to the cross-sectional area of the intermediate section of the strap so as to have a tensile strength at least equal to a tensile strength of the intermediate section of the strap. The cable tie may be a bent neck type cable tie. Preferably, the neck section has at least one recessed channel defining the reduced thickness $T_2$ and thickened side portions.

U.S. Pat. No. 6,185,792 appears to disclose a one-piece bi-directional cable tie for bundling articles having a tail at one end, a locking head at the other end and an elongate strap body therebetween that feature one or more fixed locking teeth opposite a deflectable locking pawl so as to provide ratcheting locking engagement with the two major surfaces of its strap body. The fixed teeth may provide symmetrical performance characteristics or may provide selectable performance characteristics depending on the direction of strap body insertion through the locking head. The locking head may facilitate wedging the strap body against the deflectable pawl. The deflectable pawl may include a chevron-shaped upper surface so as to provide an undercut surface for improved engagement with the locking teeth of the strap body.

U.S. Pat. No. 6,185,791 appears to disclose a releasable cable tie including a head, a tail, and an elongate strap body therebetween having plurality of teeth thereon. The head includes a passageway for receiving the tail and strap body and a slot formed in one sidewall which is in communication with the passageway, the strap body being insertable into the passageway in a locking direction for forming a loop to receive the objects to be bound. First and second shoulders are integrally attached to the first sidewall on opposite sides of the slot in opposing relation. The shoulders include first and second upwardly extending reinforcing extensions, respectively, which are each spaced a predetermined distance from the first sidewall so as to create an interstice between the extensions and first sidewall. A bridging member extends between the first and second shoulders. The head further includes a latch for releasably retaining the strap body within the head which is pivotally mounted on the bridging member and has at least one locking tooth complementary to each of the plurality of teeth on the strap body. The latch extends into the passageway through the slot such that the locking tooth engages a selected one of the plurality of teeth for substantially preventing movement of the strap body in a release direction. When the cable tie is under load in a locked position, the first and second reinforcing extensions deflect to engage the first sidewall for adding strength to the latch which enables the tie to withstand greater tensile forces. Because the latch is pivotal about the longitudinal axis of said bridging member, it may be pivoted to release the locking tooth from engagement with the selected one of plurality of teeth to permit the strap body to be moved in the release direction, the strap body being easily releasable from the head thereby allowing the tie to be reusable.

U.S. Pat. No. 5,836,053 appears to disclose a one-piece cable tie for forming a plurality of objects such as cables into a bundle that includes an elongated flexible strap having a top planar surface, a bottom planar surface, a first end and a second end. The strap further includes a plurality of transverse raised cross-members projecting up from the top planar surface, said raised cross-members being spaced along the length of the strap and defining therebetween a plurality of openings. A locking head is integrally formed to the first end of the strap. The locking head includes an outer end wall, an inner end wall and a pair of sidewalls which together define a generally rectangularly shaped strap accepting channel therebetween. A holding tab is disposed within the locking head and projects out from the inner end wall and into the strap accepting channel. The outer end wall is shaped to include an angled locking face. In use, after the second end of the strap has been inserted through the strap accepting channel and drawn tight around a bundle and the insertion force is thereafter relaxed, the stored pressure of the bundle by virtue of its configuration pivots said strap causing the rear surface of one of the raised ratchet teeth to abut against the angled locking face to lock the strap in place. At the same time, the holding tab engages with one of the openings in the strap to oppose deliberate release of the raised ratchet tooth from the locking face.

U.S. Pat. No. 4,958,414 appears to disclose a reusable tie-all or bundle fastener, which comprises a single strap, made of plastic material with a socket having a passageway therethrough at one end of the tie, and a tongue with ratchet teeth on the other end adapted to slip through the passageway in the socket. There is a locking pawl in the socket which is pivoted to the socket and which has a lever so that it can be raised to release the pawl from between the strap teeth when a loop is formed from the tie-all so as to release the tie. Two or more ties can be used in combination to form an enlarged loop.

U.S. Pat. No. 4,896,402 appears to disclose a clamping device in the form of a one-piece cable tie. The cable tie includes a band section having a free end for positioning about an object to be constrained, such as an electrical cable, and a buckle section through which the free end of the band section is inserted. In a preferred embodiment, the buckle section includes a first portion operatively connected to the band and terminating adjacent a slot. A second, raised portion of the buckle section is longitudinally or horizontally offset from the first portion. The second portion extends from a point adjacent the aforementioned slot to a free end. The width of the slot occupied by the band is greater when the band is loosely wrapped about the object constrained. The greater width of the slot when the band is loosely wrapped facilitates single or multiple wrappings of the object constrained. Any gaps between the band the object constrained are reduced by positioning only the first portion of the buckle section adjacent the object thereby improving clamping. Lips are also provided on the buckle section to accommodate positioning of the buckle section in a grooved area formed in the object being constrained. The cable tie is preferably made by a machining process in which buckle sections are alternately formed on opposing sides of a sheet of metal material to enhance the use of the material and avoid waste.

U.S. Pat. No. 4,287,644 appears to disclose a coil loop type cable tie of one-piece molded plastic construction having a flexible strap and a fastening head at one end thereof. The fastening head has a passageway running parallel to the strap and a hinged pawl extending into the passageway and having at least one tooth adapted to mesh with ratchet teeth on one side of the strap. The hinged pawl is connected to the fastening head by hinge which defines the closed end of a notch separating the hinged pawl from the rest of the fastening head. The notch opens onto a surface of the hinged pawl opposite to the surface on which its tooth or teeth are formed and preferably angles from its closed end to its open end generally toward the strap.

U.S. Pat. No. 3,660,869 appears to disclose an integral one-piece cable tie including an elongated flexible strap having a row of teeth thereon, a frame integral with one end of the strap and having an abutment wall and an end wall and an entry surface and an exit surface and a strap-receiving opening therethrough, a ledge on the end wall, and a pawl pivotally mounted on and integral with the ledge within the opening and having a set of teeth shaped complementary to the row of the teeth and defining with the end wall a strap-receiving throat disposed normal to the longitudinal axis of the strap as molded.

While ligation assemblies, tie-wraps and cable ties, as disclosed hereinabove, have been known in the art for years, issues associated with the sufficiency and consistency of tension remain problematic and/or unsolved. Moreover, current methods of ligation and elastration of animals require expensive and cumbersome banding tools. As such, there remains a genuine demand for novel elastomeric ligation and tie-wrap assemblies that remedy the detriments and/or complications associated with utilizing conventional ligation and tie-wrap assemblies and/or banding tools.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to a ligation assembly comprising, consisting essentially of, and/or consisting of: (a) a locking head, (b) an elongated strap body spaced apart from the locking head, wherein the elongated strap body includes a bottom surface that is toothless and/or otherwise free from teeth; and (c) a coupling member, wherein the coupling member is connected to and disposed between the locking head and the elongated strap body, and wherein the coupling member comprises an elastomer.

In a preferred embodiment of the present invention, the locking head and/or the elongated strap body are fabricated from a thermoplastic, including, but not limited to, an aliphatic polyamide and/or a semi-aromatic polyamide.

In another preferred embodiment of the present invention, the locking head and/or the elongated strap body are fabricated from, for example, nylon, such as nylon PA 6, nylon PA 66, nylon PA 6/66, and/or nylon PA 66/610—just to name a few.

In yet another preferred embodiment of the present invention, the locking head and/or the elongated strap body are fabricated from a polycarbonate, an acrylonitrile butadiene styrene, a copolyester, a polystyrene, a high impact polystyrene, and/or a polyphenylene oxide.

In a preferred embodiment of the present invention, the coupling member comprises a thermoplastic elastomer.

In another preferred embodiment of the present invention, the thermoplastic elastomer, includes, but is not limited to, a styrenic block copolymer, a thermoplastic olefin, an elastomeric alloy, a thermoplastic polyurethane, a thermoplastic copolyester, and/or a thermoplastic polyamide.

In yet another preferred embodiment of the present invention, the coupling member is fabricated from a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, and/or an elastolefin.

The present invention is also directed to a ligation assembly, comprising, consisting essentially of, and/or consisting of: (a) a locking head; (b) an elongated strap body, (c) a coupling member; (d) wherein the locking head comprises an end wall, an inner wall, and a pair of sidewalls that define a channel that extends from an entrance end to an exit end of the locking head, and wherein the locking head further comprises a deflectable pawl and a tab; (e) wherein the elongated strap body comprises a first end, a second end (e.g., tail), a top surface and a bottom surface, wherein the bottom surface is toothless and/or otherwise free from teeth; (f) wherein the coupling member comprises a first end, a second end, a top surface, and a bottom surface, and wherein the first end of the coupling member is associated with the first end of the elongated strap body and the second end of the coupling member is associated with the tab/strap of the locking head.

In a preferred embodiment of the present invention, the deflectable pawl extends from the inner wall of the locking head into the channel for engaging the elongated strap body.

In another preferred embodiment of the present invention, the tab/strap emanates from an outer surface of the inner wall of the locking head.

In yet another preferred embodiment of the present invention, the top and/or bottom surfaces of the elongated strap are planar.

In another aspect of the present invention, the locking head and the elongated strap body are preferably fabricated from nylon and the coupling member is preferably fabricated from a thermoplastic elastomer.

In a preferred embodiment of the present invention, the top surface and/or the bottom surface of the coupling member further comprises a pair of longitudinal recessed slots.

The present invention is further directed to a ligation assembly, comprising, consisting essentially of, and/or consisting of: (a) a locking head; (b) an elongated strap body wherein the elongated strap body includes a bottom surface that is toothless and/or otherwise free from teeth; (c) a coupling member; (d) wherein the locking head and the elongated strap body are overmolded with the coupling member; (e) wherein the locking head includes an end wall, an inner wall, and a pair of sidewalls that define a channel that extends from an entrance end to an exit end of the locking head, and wherein the locking head further includes a deflectable pawl that extends from the inner wall of the locking head into the channel for engaging the elongated strap body, and a tab that emanates from an outer surface of the inner wall of the locking head; (f) wherein the elongated strap body comprising a first end, a second end, a top surface and a bottom surface, wherein the bottom surface of the elongated strap is free from ratchet teeth; and (g) wherein the coupling member includes a first end, a second end, a top surface, and a bottom surface, and wherein the first end of the coupling member is associated with the first end of the elongated strap body and the second end of the coupling member is associated with the tab/strap of the locking head, and wherein the locking head and the elongated strap body are fabricated from nylon and the coupling member is fabricated from a thermoplastic elastomer.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

DETAILED DESCRIPTION OF THE INVENTION

Figure 1:
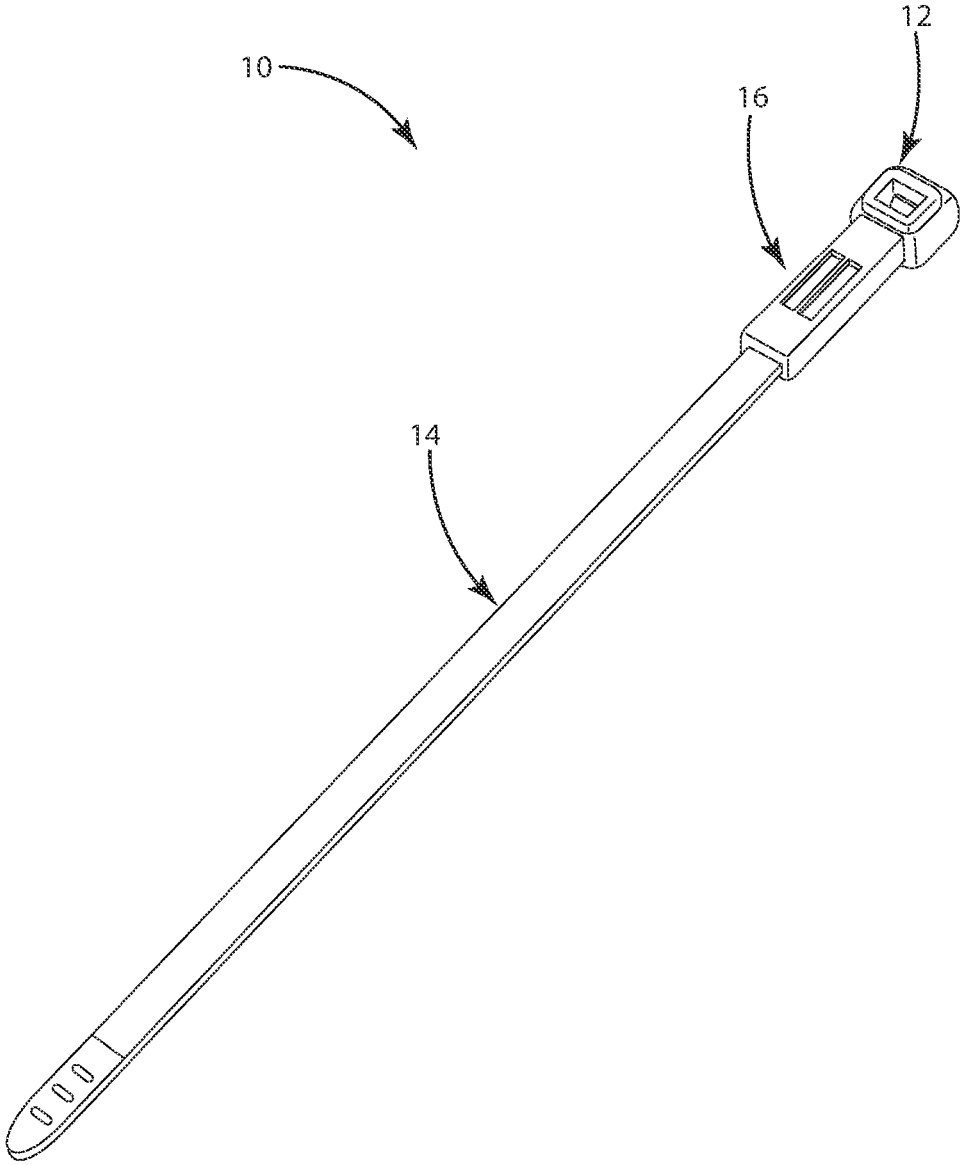
FIG. 1 of the drawings is an isometric view of a ligation assembly manufactured in accordance with the present invention.
Figure 2:
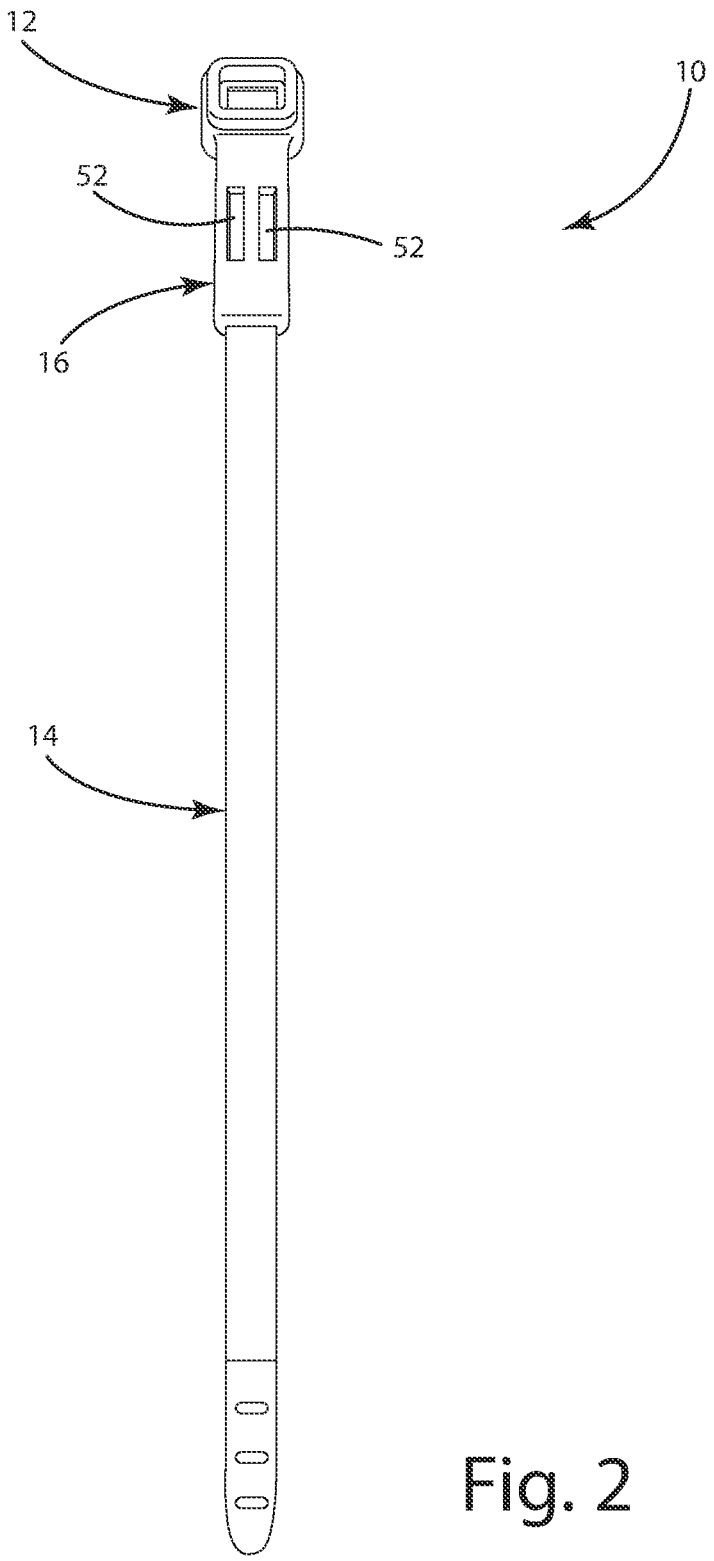
FIG. 2 of the drawings is a top view of a ligation assembly manufactured in accordance with the present invention.
Figure 3:
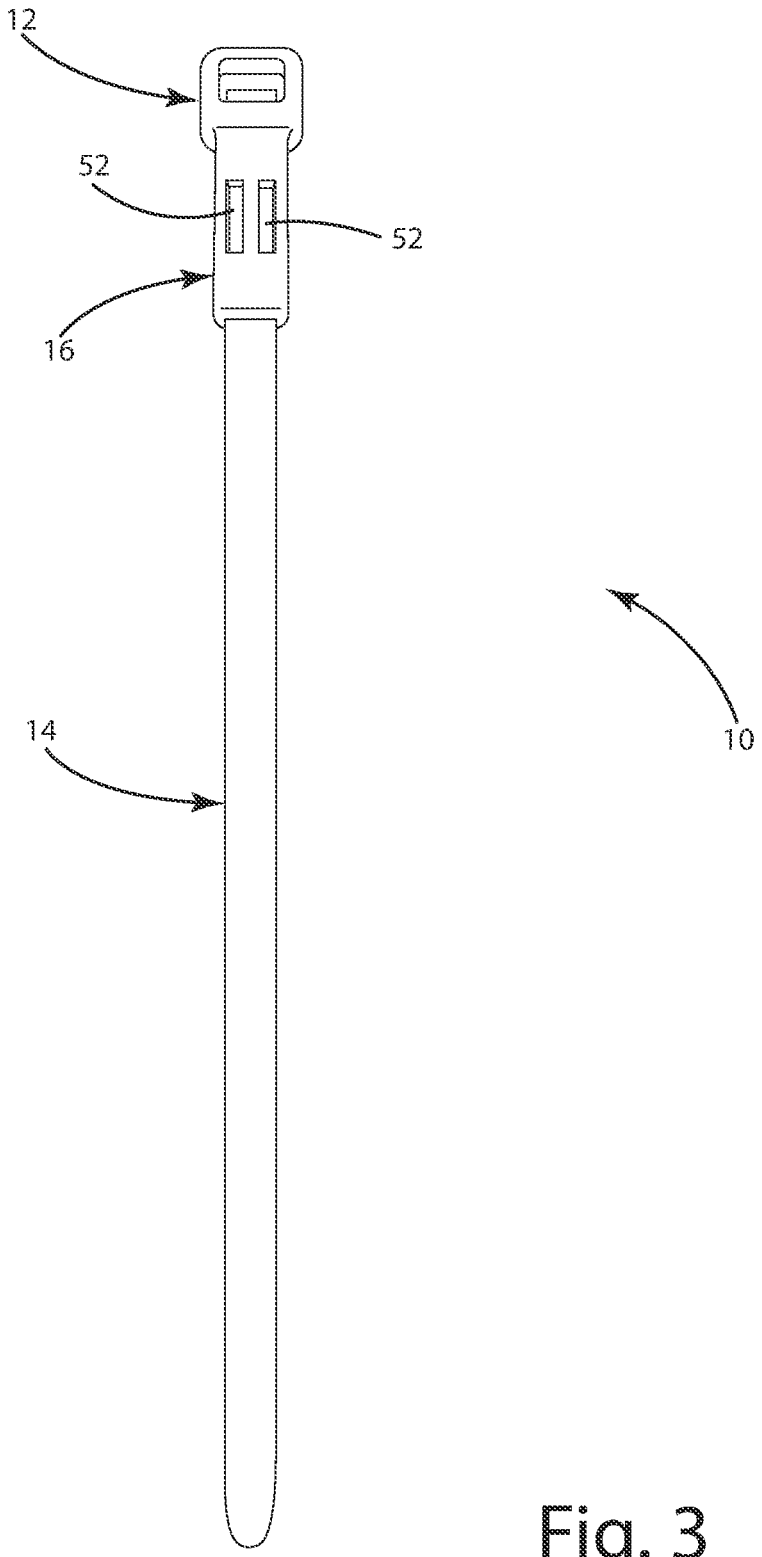
FIG. 3 of the drawings is a bottom view of a ligation assembly manufactured in accordance with the present invention.

While this invention is susceptible of embodiment in many different forms, there is disclosed and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters.

In addition, it will be understood that the drawings are merely schematic representations of one or more embodiments of the invention, and some of the components may have been distorted from their actual scale for purposes of pictorial clarity.

Referring now to the drawings and collectively to FIGS. 1-6, ligation or tie-wrap assembly 10 is shown, which generally comprises locking head 12, elongated strap body 14, which is preferably spaced apart from locking head 12, and coupling member 16.

In a preferred embodiment of the present invention, coupling member 16 is connected to and disposed between locking head 12 and elongated strap body 14, and preferably comprises an elastomer and/or elastomeric material so that tie-wrap assembly 10 can positively engage a banded object (e.g., the scrotum of an animal during castration/elastration, the limb of a human when used as a tourniquet, etcetera) with both constant and sufficient tension relative to conventional tie-wraps.

Locking head 12 of tie-wrap assembly 10 preferably includes end wall 18, inner wall 20, and a pair of sidewalls 22 and 22' that define channel 24 which extends from entrance end 26 to exit end 28 of locking head 12. Locking head 12 preferably further includes deflectable pawl and/or hingeless wedge 30. Deflectable pawl 30 preferably extends from inner wall 20 of locking head 12 into channel 24 for lockably engaging elongated strap body 14.

Locking head 12 of tie-wrap assembly 10 also preferably includes tab/connecting strap 32. Tab 32 preferably emanates from an outer surface of inner wall 20 of locking head 12.

Elongated strap body 14 preferably includes first end 34, second end or tail 36, top surface 38 and bottom surface 40. As a significant improvement, bottom surface 40 of elongated strap body 14 is toothless, free from and/or devoid of ratchet teeth. Preferably, the bottom surface is smooth and planar. The ratchet teeth used in prior art ligation assemblies, among other things, are expensive to manufacture and not necessary for ligation purposes. The ratchet teeth also created a region where moisture is trapped and irritates the animal undergoing the ligation procedure. Moreover, the toothless design of the present invention allows the ligation assembly to slide more easily compared to ligation assemblies having ratchet teeth, which further reduces irrigation/agitation to the animal undergoing ligation. Furthermore, the toothless implementations of the present invention result in significantly less chafing to the fingers of the person installing the ligation assembly. Notably, an individual may install more than 100 ligation assemblies at a time, and the ratchet teeth can cause the fingertips of the installer become raw and/or otherwise painful. As such, a smooth surface is both better for the installer and the animal.

Coupling member 16 of ligation/tie-wrap assembly 10 preferably includes first end 44, second end 46, top surface 48, and bottom surface 50. First end 44 of coupling member 16 is preferably associated (e.g., secured, fixed, attached, fastened, etcetera) with first end 34 of elongated strap body 14, and second end 46 of coupling member 16 is preferably associated (e.g., secured, fixed, attached, fastened, etcetera) with tab 32 of locking head 12. As is shown in FIGS. 1-4, coupling member 16 may substantially cover end wall 18, inner wall 20, sidewalls 22 and 22', and tab 32 of locking head 12, or, alternatively, as is shown in FIGS. 5-6, coupling member 16 may engage/cover only tab 32 of locking head 12.

Figure 8:
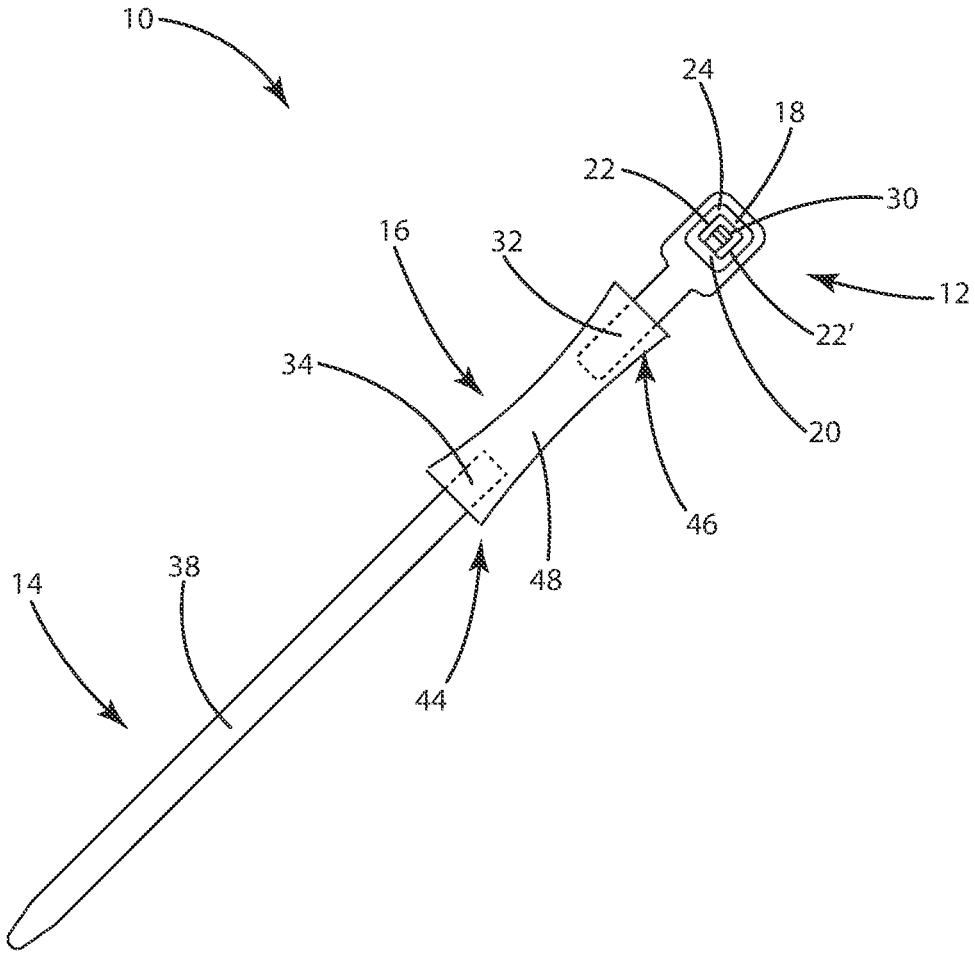
FIG. 8 of the drawings is a top view of an alternative embodiment of a ligation assembly manufactured in accordance with the present invention.

In one embodiment of the present invention, coupling member 16 includes elongated or longitudinal recessed slots 52 on one or more of top and bottom surfaces 48 and 50, respectively. Without being bound to any one particular theory, it is believed that slots 52 provide coupling member 16 with superior elasticity and malleability for elastration and/or tourniquet applications. As is shown in FIG. 8, coupling member 16 may include a flexible/elastic member that includes a pair of concave sides. These concave sides allow the central region to have a smaller diameter, thus increasing the stretchability of the coupling member without adversely affecting connection to the locking head and strap member.

In accordance with the present invention, locking head 12 and elongated strap body 14 are preferably fabricated from a thermoplastic substrate, such as, for example, an aliphatic polyamide and/or a semi-aromatic polyamide. Specific examples include nylon, such as nylon PA 6, nylon PA 66, nylon PA 6/66, and/or nylon PA 66/610.5.

Locking head 12 and elongated strap body 14 may also be fabricated from other materials, such as, polycarbonates, acrylonitrile butadiene styrenes, copolyesters, polystyrenes, high impact polystyrenes, polyphenylene oxides—just to name a few. It will be understood that elongated strap body 14 should not be fabricated from an elastomeric material because such elastomeric material can compromise the sufficiency and consistency of engagement of a banded object.

In accordance with the present invention, coupling member 16 is preferably fabricated from a thermoplastic elastomer, including, but not limited to, a styrenic block copolymer, a thermoplastic olefin, an elastomeric alloy, a thermoplastic polyurethane, a thermoplastic copolyester, a thermoplastic polyamide, etcetera.

Coupling member 16 may also be fabricated from one or more elastomeric materials, including, but not limited to, natural polyisoprenes, synthetic polyisoprenes, polybutadienes, chloroprene rubbers, butyl rubbers, halogenated butyl rubbers, styrene-butadiene rubbers, nitrile rubbers, hydrogenated nitrile rubbers, ethylene propylene rubbers, ethylene propylene diene rubbers, epichlorohydrin rubbers, polyacrylic rubbers, silicone rubbers, fluorosilicone rubbers, fluoroelastomers, perfluoroelastomers, polyether block amides, chlorosulfonated, ethylene-vinyl acetates, resilins, elastins, a polysulfide rubbers, elastolefins, and combinations thereof.

In a preferred embodiment of the present invention, locking head 12 and elongated strap body 14 are overmolded with coupling member 16. It will be understood that coupling member 16 may also be associated with locking head 12 and/or elongated strap body 14 via etch coating, dip coating, spin coating, brush coating and/or spray coating—including, but not limited to, cold spraying, thermal spraying, high velocity spraying (e.g., supersonic), low velocity spraying (e.g., subsonic), triboelectric discharge kinetic spraying and other similar processes.

Referring once again to the drawings and to FIG. 7 in particular, an alternative embodiment of ligation or tie-wrap assembly 10 is shown in an exploded, isometric view, which generally comprises locking head 12, elongated strap body 14, which is preferably spaced apart from locking head 12, and coupling member 16. In a preferred embodiment of the present invention, coupling member 16 is connected to and disposed between locking head 12 and elongated strap body 14, and preferably comprises an elastomer and/or elastomeric material so that tie-wrap assembly 10 can positively engage a banded object (e.g., the scrotum of an animal during castration/elastration, the limb of a human when used as a tourniquet, etcetera) with both constant and sufficient tension relative to conventional tie-wraps.

Figure 4:
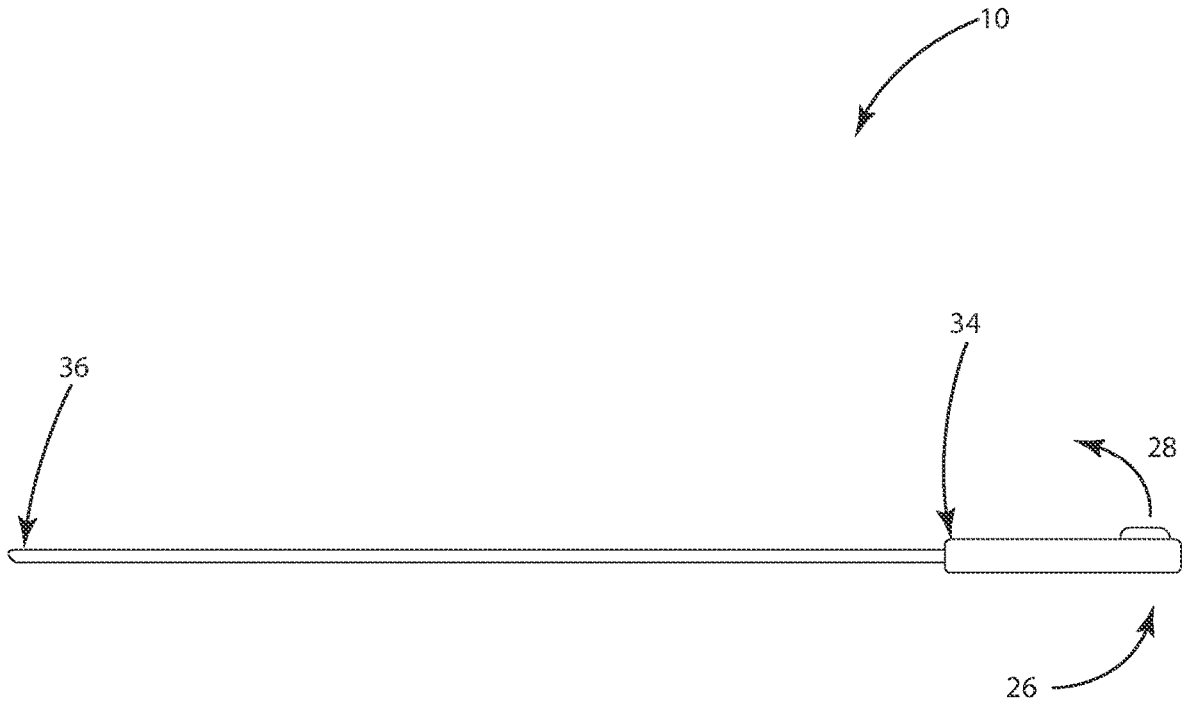
FIG. 4 of the drawings is a side view of a ligation assembly manufactured in accordance with the present invention.
Figure 5:
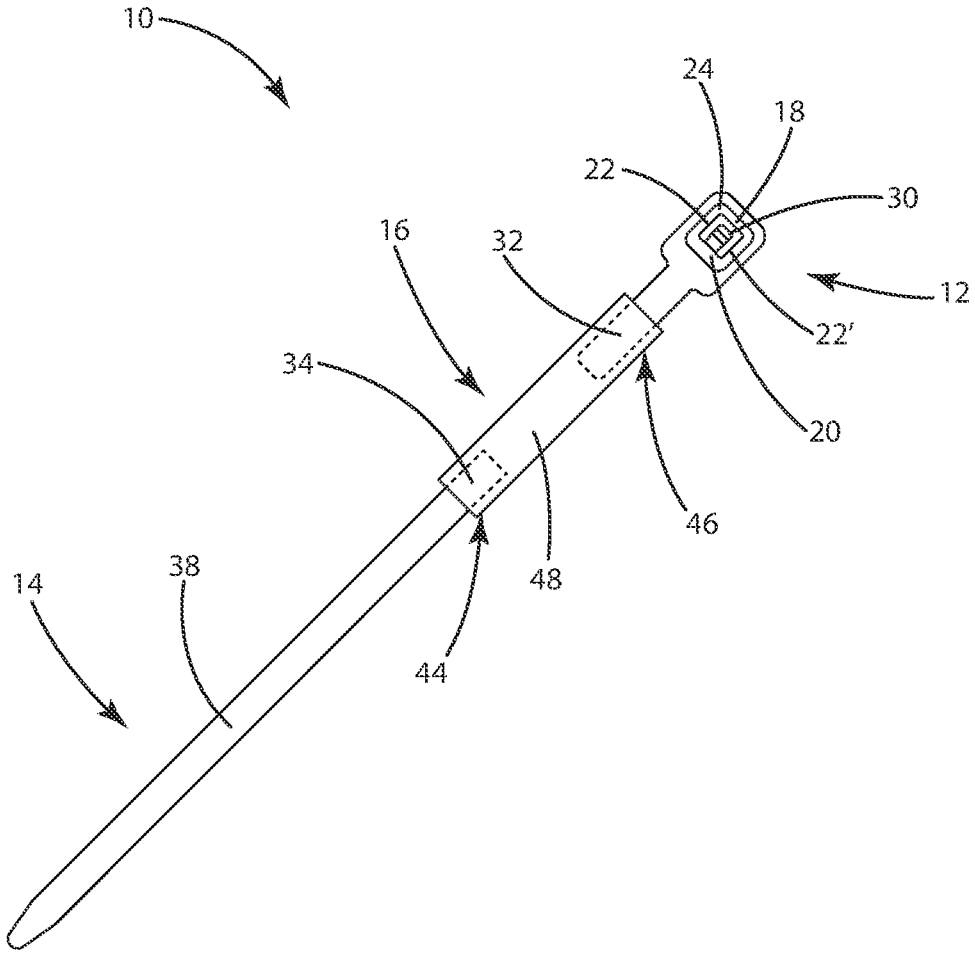
FIG. 5 of the drawings is a top view of an alternative embodiment of a ligation assembly manufactured in accordance with the present invention.
Figure 6:
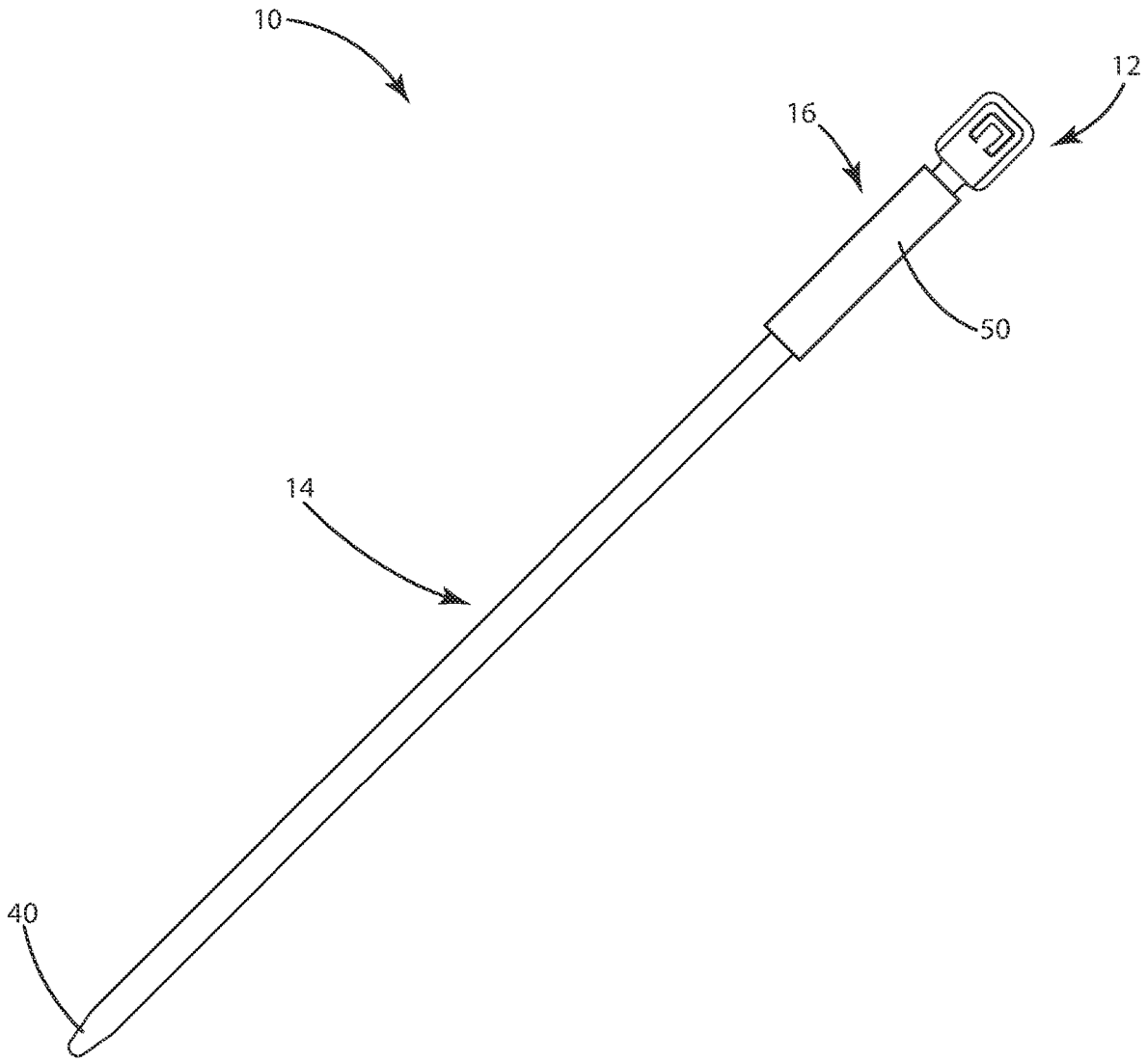
FIG. 6 of the drawings is a bottom view of an alternative embodiment of a ligation assembly manufactured in accordance with the present invention.

In this embodiment, locking head 12 of tie-wrap assembly 10 preferably includes an end wall, an inner wall, and a pair of sidewalls that define a channel which extends from an entrance end to an exit end of locking head 12—in an analogous manner to the locking head disclosed in FIGS. 4-5. Locking head 12 preferably further includes a deflectable pawl and/or a hingeless wedge. The deflectable pawl preferably extends from the inner wall of locking head 12 into the channel for lockably engaging elongated strap body 14—in an analogous manner to the locking head disclosed in FIG. 5.

Figure 7:
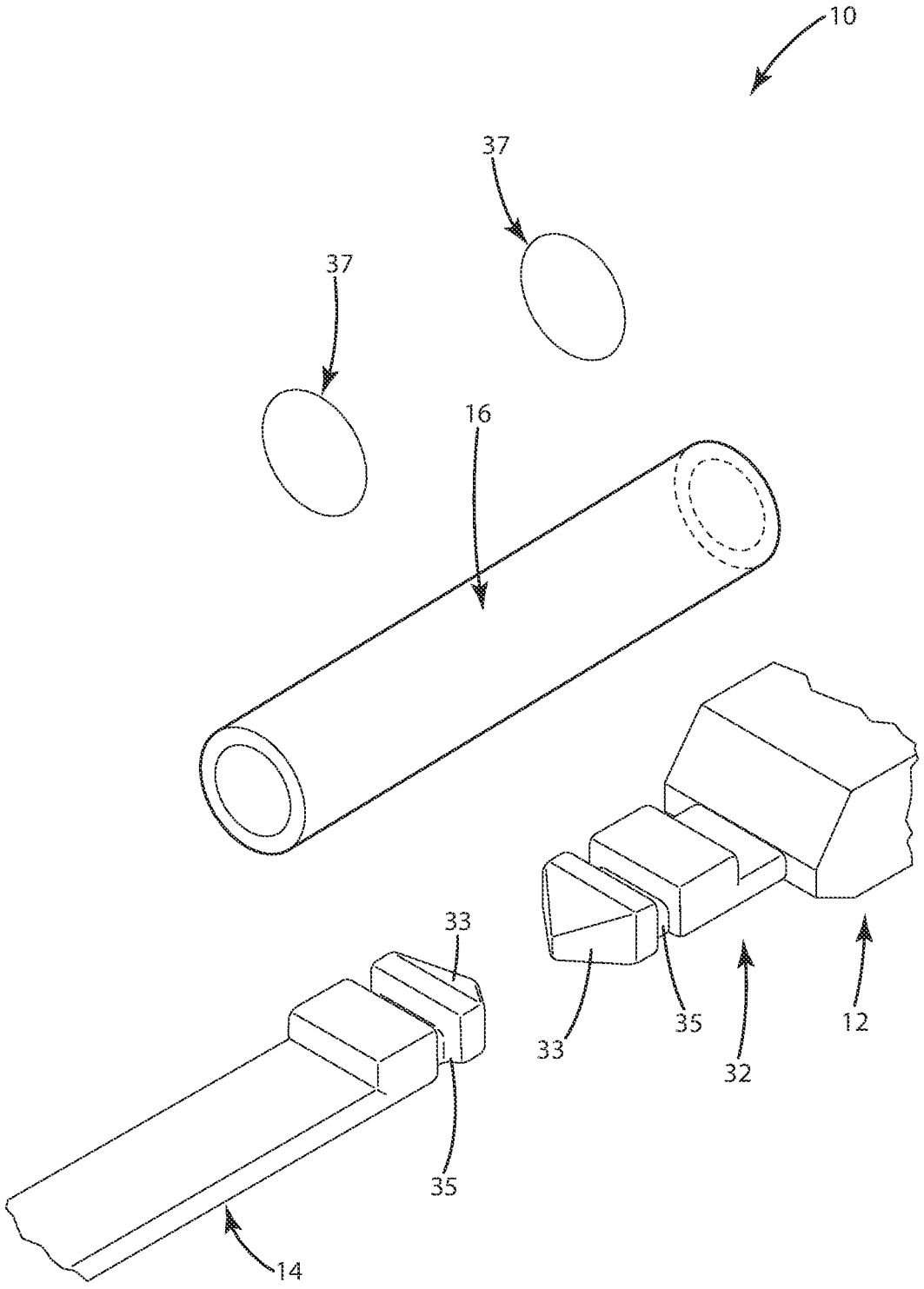
FIG. 7 of the drawings is an exploded isometric view of an alternative embodiment of a ligation assembly manufactured in accordance with the present invention.

As is shown in FIG. 7, locking head 12 of ligation or tie-wrap assembly 10 also preferably includes tab/connecting strap 32. Tab 32 preferably emanates from an outer surface of the inner wall of locking head 12. Connecting strap 32 preferably includes terminal, substantially arrow-shaped head and/or arrow-shaped head 33. It will be understood that arrow-shaped head 33 enhances the ease of which connecting strap 32 is inserted and secured into coupling member 16. Connecting strap 32 further preferably includes recessed region 35 for enhanced securement of coupling member 16 in cooperation with fastener/band 37.

Elongated strap body 14 preferably includes a first end, a second end or tail, a top surface and a bottom surface. In one embodiment of the present invention, the bottom surface of elongated strap body 14 is smooth, planar, and free from ratchet teeth. As is best shown in FIG. 7, the first end of elongated strap body 14 preferably terminates with a substantially arrow-shaped head and/or arrow-shaped head 33. It will be understood that arrow-shaped head 33 enhances the ease of which the end of elongated strap body 14 is inserted and secured into coupling member 16. The first end of elongated strap body 14 further preferably includes recessed region 35 for enhanced securement of coupling member 16 in cooperation with fastener/band 37.

It will be understood that coupling member 16 of ligation or tie-wrap assembly 10 is preferably inserted over arrow-shaped heads 33 and recessed regions 35 of locking head 12 and elongated strap body 14. Coupling member 16 is preferably secured to both locking head 12 and elongated strap body 14 via conventional fasteners and/or securement bands 37.

Fasteners 37 may optionally comprise string, rope, cord, rubber and/or plastic bands, metal wire, staples, crimp bands, etcetera. It will be further understood that, in this embodiment, coupling member 16 is preferably fabricated from a thermoplastic elastomer and/or an elastomeric material—as is disclosed herein above.

Ligation or tie-wrap assembly 10 of the present invention may be utilized for conventional applications where tie-wraps, cable ties, hose ties, zip ties, zap straps, and/or panduit straps are utilized and/or for specialized applications, such as for elastration and/or tourniquet applications.

In one application of the present invention, a male animal is provided. Next, ligation or tie-wrap assembly 10 is secured (e.g., banded) around the scrotum of the male animal. Once secured, the tie-wrap provides sufficient and constant tension such that necrosis caused by insufficient blood supply to the scrotum and testicles of the animal occurs. Notably, the necrosis occurs with no or minimal pain to the animal and/or utilization of banding tools. After necrosis sets in, the scrotum and testicles of the animal naturally disassociate from the animal, thereby steering the animal in a humane manner.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. A ligation assembly, consisting of:

a locking head, an elongated strap body, and a coupling member, wherein the locking head and the elongated strap body are overmolded with the coupling member;

wherein the locking head includes an end wall, an inner wall, and a pair of sidewalls that define a channel that extends from an entrance end to an exit end of the locking head, and wherein the locking head further includes a deflectable pawl that extends from the inner wall of the locking head into the channel for engaging the elongated strap body, and a tab that emanates from an outer surface of the inner wall of the locking head;

wherein the elongated strap body comprising a first proximal end, a second distal tail end, a top surface and a bottom surface extending from the first proximal end to the second distal tail end of the elongated strap body, wherein the entire bottom surface of the elongated strap body is free from ratchet teeth, and wherein the bottom surface of the elongated strap body is on a same side as the entrance end of the locking head; and wherein the coupling member includes a first end, a second end, a top surface, and a bottom surface, and wherein the first end of the coupling member is associated with the first end of the elongated strap body and the second end of the coupling member is associated with the tab of the locking head, and wherein the locking head and the elongated strap body are fabricated from nylon and the coupling member is fabricated from a thermoplastic elastomer.

* * * * *